United States Patent [19]

Montaner

[11] Patent Number: 5,064,105

[45] Date of Patent: Nov. 12, 1991

[54] DECOMPRESSION DEVICE FOR SUCTION PUMPS

[75] Inventor: Pere P. Montaner, Barcelona, Spain

[73] Assignee: Monturas, S.A., Barcelona, Spain

[21] Appl. No.: 650,176

[22] Filed: Feb. 4, 1991

[30] Foreign Application Priority Data

Mar. 29, 1990 [ES] Spain ..... 9000891

[51] Int. Cl.[5] ..... B05B 11/02

[52] U.S. Cl. ..... 222/321; 222/385; 239/333; 417/435

[58] Field of Search ..... 222/321, 383, 385; 239/333; 417/435

[56] References Cited

U.S. PATENT DOCUMENTS

| | | | |
|---|---|---|---|
| 3,774,849 | 11/1973 | Boris | 222/321 |
| 4,051,983 | 10/1977 | Anderson | 222/321 |
| 4,437,588 | 3/1984 | Shay | 222/321 |
| 4,895,279 | 1/1990 | Schultz | 222/321 |
| 4,941,595 | 7/1990 | Montaner | 222/385 X |

*Primary Examiner*—Kevin P. Shaver

*Attorney, Agent, or Firm*—Staas & Halsey

[57] ABSTRACT

A decompression device for suction pumps having a pumping chamber and a plunger formed with a resilient lower lip, which in the end-of-stroke position reaches a lower limit level and which comprises at least one protuberance in the surface of the pumping chamber extending on both sides of the lower limit level and determining a lower edge and an upper edge, between which at least one continuous slot extends.

4 Claims, 2 Drawing Sheets

DECOMPRESSION DEVICE FOR SUCTION PUMPS

BACKGROUND OF THE INVENTION

The invention relates to a decompression device for suction pumps which comprise a pumping chamber with a cylinder defining an axis and a plunger provided with a resilient lower lip, the plunger being slidingly engaged in said cylinder between an upper, rest position and a lower end-of-stroke position, in which said lower lip reaches a lower limit level within said cylinder.

The subject device is particularly applicable to pumps for dispensing fluids contained in a container.

PRIOR ART

As is known, to make the pump work, the plunger is forced downwardly creating a pressure within the pumping chamber, so that this pressure closes the valve placing the chamber in communication with the container. The contained liquid, being incompressible, opens the valve placing said chamber in communication with the outside, thereby dispensing the liquid. When the plunger is released, this returns to the upper rest position thereof urged by one or more springs, whereby a depression is formed in the pumping chamber, reversing the position of the valves. This reversal causes the pumping chamber to be filled with liquid from the container.

Nevertheless, when it is desired to dispense liquid for the first time, the pumping chamber is logically only full of air. Since this is highly compressible, the valve for communication with the outside opens with difficulty, whereby little air is released from the chamber. When the plunger is released, the air decompresses and a volume of liquid only in proportion to the small amount of air that has been released enters the chamber. Under these circumstances, it is necessary to actuate the plunger several times to achieve priming of the pump.

In certain embodiments, cells or hollows which are reached by the plunger lower lip in the lower end-of-stroke position thereof are formed in the cylinder wall. Then, said cells or hollows place the portion of the pumping chamber where the air has been compressed in communication with a space above said lip and, therefore, the compressed air escapes through the cells or hollows. It may be said that a by-pass of said lip has been formed.

Nevertheless, the above described embodiment creates many difficulties for producing the cylinder in a molding operation, since it is hard to strip from the mold, making manufacture notably more expensive.

U.S. Pat. No. 3,774,849 teaches a convex portion in the cylinder wall which, on being reached by the plunger lower lip, deforms said lip. Such deformation leaves small axial interstices between the plunger and cylinder forming passages for the compressed air to escape. Nevertheless, in certain cases, the adaptation of the deformed portion and the convex portion is very close, whereby the size of such interstices is very small and insufficient for decompressing the pumping chamber.

U.S. Pat. No. 4,051,983 teaches a small axially orientated prismatic protuberance, replacing the convex portion mentioned in the foregoing paragraph. With this protuberance, the degree of adaptation of the plunger lip to the irregularity caused by the protuberance is usually smaller. Nevertheless, the interstices formed may scarcely be predetermined and the results are variable.

SUMMARY OF THE INVENTION

It is an object of the invention to overcome the above drawbacks, which is achieved with a device of the type mentioned at the beginning which is characterised in that it comprises at least one protuberance on the surface of said pumping chamber extending on both sides of said lower limit level, determining a lower edge and an upper edge, the latter gently fairing into the pumping chamber surface, the protuberance being formed with at least one continuous slot extending between said edges.

With the device of the invention, there is no possibility of the deformed portion of the lower lip penetrating in the slot, whereby constant dimensions are obtained of the passage allowing decompression of the pumping chamber.

BRIEF DESCRIPTION OF THE DRAWING

Further advantages and features of the invention will become evident from the following description in which, without any limitation, there is described a preferred embodiment of the invention, with reference to the accompanying drawings, in which.

DETAILED DESCRIPTION OF THE INVENTION

Figure 1:
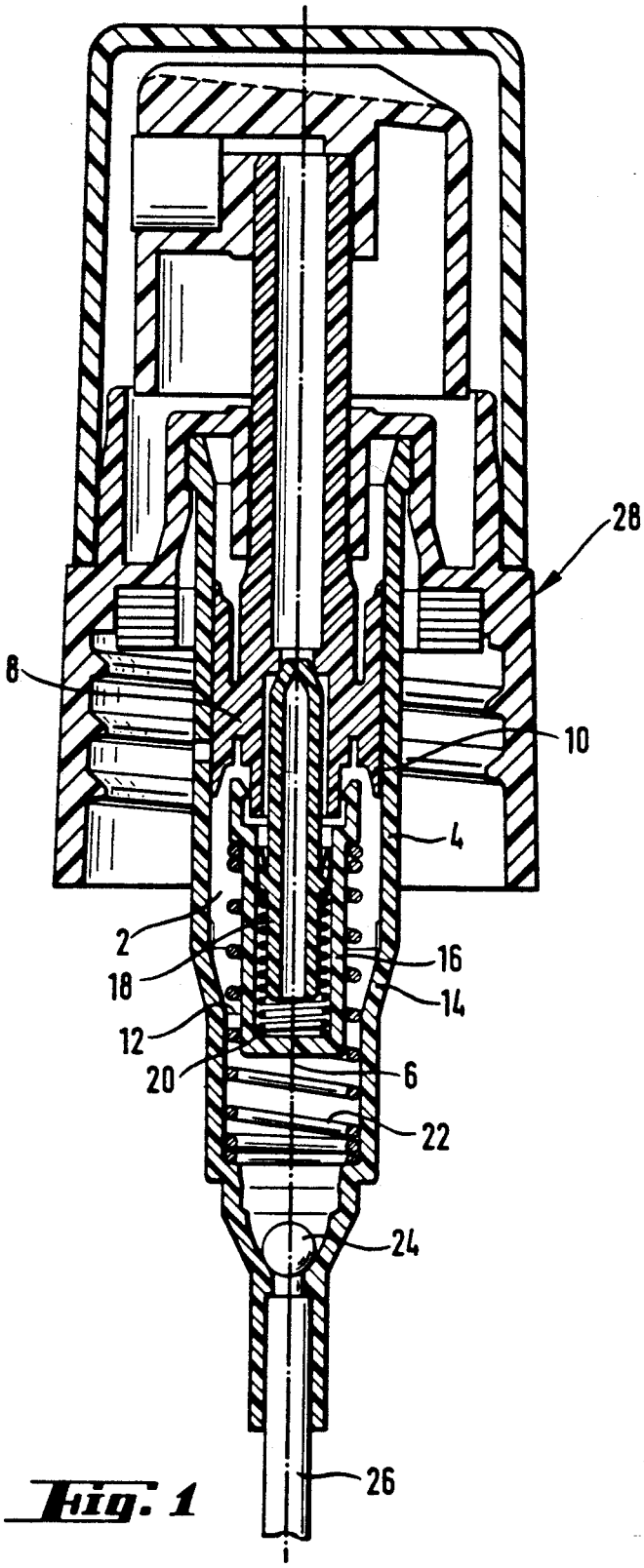
FIG. 1 is a complete axial section view of a pump, the plunger being in the upper, rest position.
Figure 2:
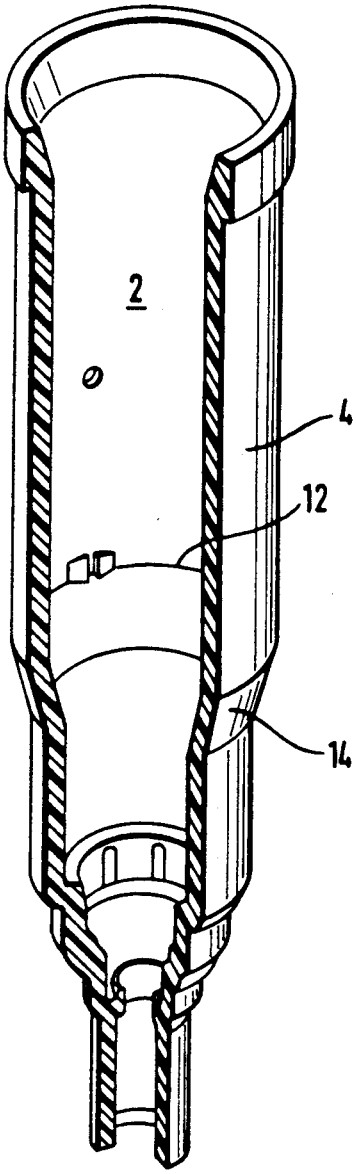
FIG. 2 is a perspective view of a part of a suction pump, in section on two radial planes forming an angle and comprising the decompression device of the present invention.
Figure 3:
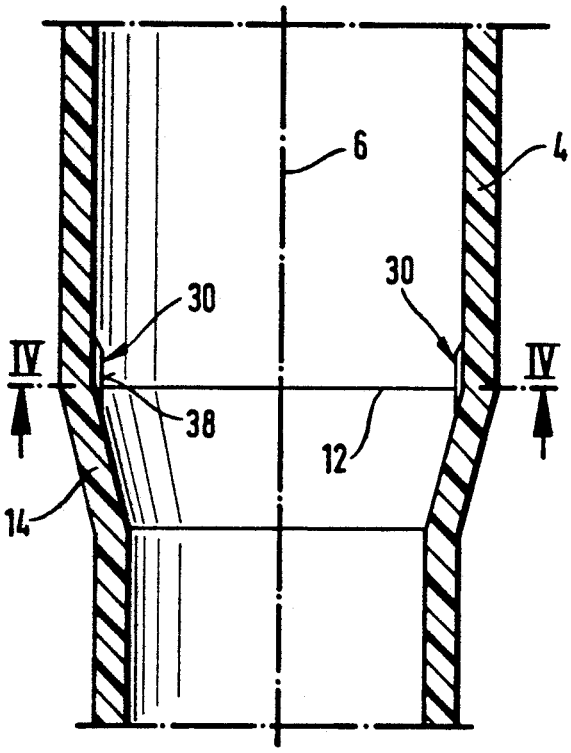
FIG. 3 is an axial view, partly in section, of the pumping chamber of the suction pump, on a larger scale.
Figure 4:
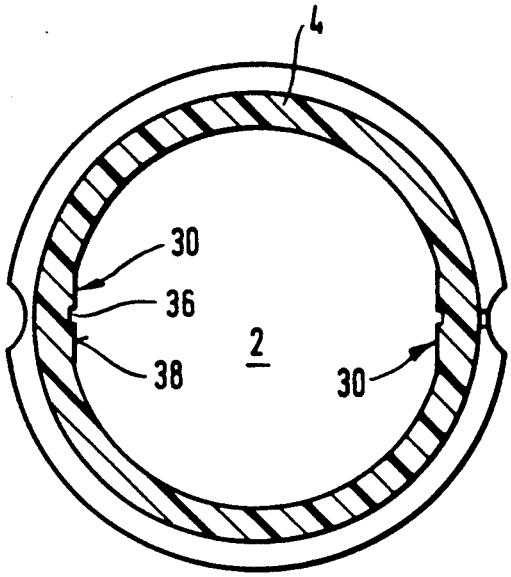
FIG. 4 is a cross section view on the line IV—IV of FIG. 3.
Figure 5:
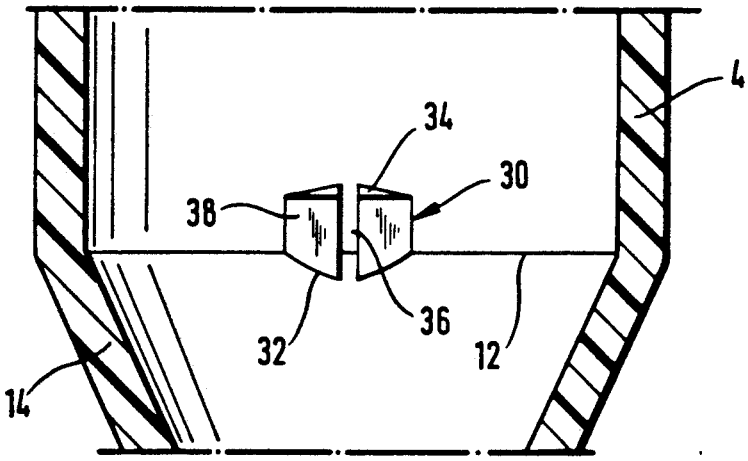
FIG. 5 is a cross section view, on a larger scale, showing a front view of the decompression device, the dimensions of which have been exaggerated.

The decompression device of the present invention is applicable to suction pumps such as those used for dispensing fluids used for perfumery or for cleaning.

In a known way, these pumps comprise a plurality of parts, although reference will be made only to those parts directly related with the invention.

The latter parts are, particularly, a pumping chamber 2 the walls of which comprise a cylinder 4 defining an axis 6. Inside said cylinder, there is a plunger 8 which is formed with a lower lip 10 which is provided with a certain degree of resilience so that it may contract slightly, as stated hereinafter. The plunger may slide in the cylinder between an upper, rest position, which is the one shown, and a lower end-of-stroke position, not shown, in which the maximum compression in the pumping chamber 2 is achieved. In this lower position, the lower lip 10 reaches a lower limit level 12 in the cylinder. Preferably below this lower limit level, the pumping chamber 2 is formed with a frustoconical surface 14.

In FIG. 1 there is to be appreciated a secondary cylinder 16, a secondary piston 18, two springs 20 and 22, a ball valve 24, a dip tube 26 and operating and dispensing means 28, which are not described in detail as said above, since there is no need to know their detailed structure and operation for an understanding of the invention.

This is to be found substantially in one or more small protuberances 30, on the surface of the pumping chamber 2, extending from one side to the other of the lower limit level 12. The protuberances determine a lower edge 32 which is below the lower limit level 12 and an upper shoulder 34 which fairs into the inner surface of the cylinder 4. Each shoulder 30 is formed with at least one slot 36 also extending on both sides of the lower limit level 12 and preferably between the edges 32 and 34.

Preferably, the front surface 38 of the shoulder is a flat surface parallel to the axis 6 of the cylinder 4, whereby when there is the frustoconical portion 14, the lower edge 32 results from an intersection of a plane and a tapering surface and therefore said edge 32 has the shape of a conical curve, particularly a hyperbole, with the break formed by the slot 36.

To improve the operation of the device, it is deemed preferable to provide two shoulders in diametrically opposite positions.

With the embodiment described above, when the plunger 8 is moved to the lower end-of-stroke position thereof for priming the pump, the lip 10 reaches the shoulder(s) 30. Then the lip is gently compressed to a slight degree owing to the special configuration of the upper edge 34. Therefore, the slots 36 communicate the spaces on both sides of the lip and the compressed air in the pumping chamber escapes through the slots, whereby the pump is usually primed by operating the plunger only once.

Furthermore, the shape of the shoulders does not cause problems for stripping the cylinder containing them from the mold.

What I claim is:

1. A decompression device for suction pumps which comprises a pumping chamber with a cylinder defining an axis and a plunger provided with a resilient lower lip, the plunger being slidingly engaged in said cylinder between an upper, rest position and a lower end-of-stroke position, in which said lower lip reaches a lower limit level in said cylinder, the device comprising at least one protuberance on the surface of said pumping chamber extending on both sides of said lower limit level, said protuberance having a lower edge and an upper edge, the upper edge gently fairing to the pumping chamber surface, the protuberance being formed with at least one continuous slot extending between said edges.

2. The device of claim 1, wherein said protuberance is formed with a flat front surface parallel to said axis, in which said slot defines two portions of said protuberance.

3. The device of claim 2, wherein said pumping chamber surface below said lower limit level is frustoconical.

4. The device of claim 1, wherein said at least one protuberance comprises two diametrically opposite protuberances.

* * * * *